US005564351A

United States Patent [19]

Wagner

[11] Patent Number: 5,564,351

[45] **Date of Patent: *Oct. 15, 1996**

[54] EQUIPMENT AND PROCESS FOR MOLECULAR DECOMPOSITION OF CHLORINATED HYDROCARBONS

[76] Inventor: Anthony S. Wagner, 13709 Hwy. 71, West, Bee Caves, Tex. 78738-3117

[ * ] Notice: The term of this patent shall not extend beyond the expiration date of Pat. No. 5,359,947.

[21] Appl. No.: 328,270

[22] Filed: Oct. 3, 1994

Related U.S. Application Data

[63] Continuation-in-part of Ser. No. 225,612, Apr. 10, 1994, Pat. No. 5,461,991, which is a continuation-in-part of Ser. No. 221,521, Apr. 1, 1994, which is a continuation-in-part of Ser. No. 103,122, Aug. 9, 1993, Pat. No. 5,359,947, which is a continuation-in-part of Ser. No. 982,450, Nov. 27, 1992, Pat. No. 5,271,341, which is a continuation-in-part of Ser. No. 699,756, May 14, 1991, Pat. No. 5,171,546, which is a continuation-in-part of Ser. No. 524,278, May 16, 1990, Pat. No. 5,000,101.

[51] Int. Cl.[6] ..... F23G 7/04

[52] U.S. Cl. ..... 110/346; 110/214; 110/235; 588/201

[58] Field of Search ..... 110/346, 235, 110/214, 250, 204, 214, 238; 588/201

[56] References Cited

U.S. PATENT DOCUMENTS

| | | | |
|---|---|---|---|
| 5,029,821 | 7/1991 | Bar-on et al. | 266/79 |
| 5,191,154 | 3/1993 | Nagel | 588/201 |
| 5,271,341 | 12/1993 | Wagner | 110/346 |
| 5,301,620 | 4/1994 | Nagel et al. | 110/346 |
| 5,359,947 | 11/1994 | Wagner | 110/346 |

*Primary Examiner*—William Doerrler
*Attorney, Agent, or Firm*—Joseph F. Long

[57] ABSTRACT

A process and equipment for pyrolytic decomposition of chlorinated compounds in a molten metal bath in the absence of air to elemental products with recovery of the carbon and chlorine is disclosed.

13 Claims, 4 Drawing Sheets

EQUIPMENT AND PROCESS FOR MOLECULAR DECOMPOSITION OF CHLORINATED HYDROCARBONS

This application is a continuation-in-part of Ser. No. 08/225,612 entitled "Equipment and Process for Molten Alloy Pyrolysis of Hazardous Liquid Waste" filed Apr. 10, 1994, now U.S. Pat. No. 5,461,991, which is a C.I.P. of Ser. No. 08/221,521 filed Apr. 1, 1994 which is a C.I.P. of Ser. No. 08/103,122 filed Aug. 9, 1993, now U.S. Pat. No. 5,359,947, entitled "Equipment and Process for Waste Pyrolysis and Off-Gas Oxidative Treatment" which is continuation-in-part of Ser. No. 07/982,450, filed Nov. 27, 1992, now U.S. Pat. No. 5,271,341 and entitled "Equipment and Process for Medical Waste Disintegration and Reclamation" and which is a C.I.P. of Ser. No. 07/699,756, filed May 14, 1991, now U.S. Pat. No. 5,171,546, entitled "Waste Treatment and Metal Reactant Alloy Composition" which in turn is a C.I.P. of Ser. No. 524,278, filed May 16, 1990, now U.S. Pat. No. 5,000,101, entitled "A Hazardous Waste Reclamation Process."

BACKGROUND

The closest prior art to the present invention is probably Ser. No. 08/103,122 entitled "Equipment and Process for Waste Pyrolysis and Off-Gas Oxidative Treatment" but differs significantly in that process and equipment is designed specifically to treat chlorinated hydrocarbon waste by dissolution of the waste beneath the surface of a molten metal with continuous draw off of the molten chloride formed by maximum contact with the molten metal with the waste. Magnesium, zinc, calcium and other metals that form non-sublimable chlorides that remain molten at about or below 850° C. would be suitable. The preferred metal is magnesium but magnesium-zinc mixture or zinc alone should be equally usable.

Magnesium metal used for the molten bath may be of low purity. Scrap magnesium should be quite satisfactory.

Large volumes of the chlorinated waste exist and equipment in this process is specifically designed to allow safe, complete destruction to harmless, environmentally innocuous products, essentially carbon, hydrogen and magnesium chloride.

In this process the magnesium may be heated and held molten by electrical induction heating or by fossil fuel. The molten bath is held at approximately 750° to 900° C. by continuous heating.

Above 800° C. essentially all organic materials, including organic pathogens, are broken down into carbon and gaseous products. Negative ions such as chlorine, bromide, etc., in the organic compounds will react with the alloy and be held as non volatile salts. Magnesium chloride salt formed will be molten. The carbon, and hydrogen and, other oxidizable products, if present after pyrolysis are oxidized in the oxidation chamber. Glass will melt and metal will dissolve or remain in the molten bath. Water in the form of steam will pass into the aqueous scrubber. Normally negative ions such as chlorine will be held by the magnesium; however salts that sublime such as aluminum chloride would be removed in the aqueous scrubber.

The magnesium chloride in the molten bath is drawn off continuously by an overflow level control to a sealed container for recovery of the magnesium and chlorine. A known electrolytic process may be used to separate the magnesium and chlorine. The magnesium could be recycled and chlorine is readily saleable. Carbon and hydrogen may be oxidized to carbon dioxide and water or carbon may be separated and used as carbon. Air is essentially excluded from the pyrolysis unit and the small amount of air that my enter with the magnesium as charged reacts to oxidize carbon to carbon monoxide or dioxide.

SUMMARY OF THE INVENTION

The invention comprises equipment and process to completely disintegrate molecules of chlorinated hydrocarbons. A specially designed under the surface feed unit is used to disperse the waste feed below the molten metal surface and provide a tortious path for the decomposition products of the waste through the molten metal to insure complete decomposition. The magnesium metal reacts with the chlorine formed by the decomposition to form magnesium chloride which may be drawn off and electrolyzed to give chlorine for sale and magnesium for recycle.

After the pyrolysis treatment the resulting off-gas products are, in one embodiment, carried through a ceramic section of the off-gas line that is heated to about 400° C. and then into an oxidation chamber followed by a scrubbing system. The off-gas from the final aqueous scrubber should contain only nitrogen, carbon dioxide and some oxygen as excess oxygen may be used in the oxidation system.

DETAILED DESCRIPTION OF THE INVENTION

The process and equipment of the invention may be best described from the drawings.

Figure 1:
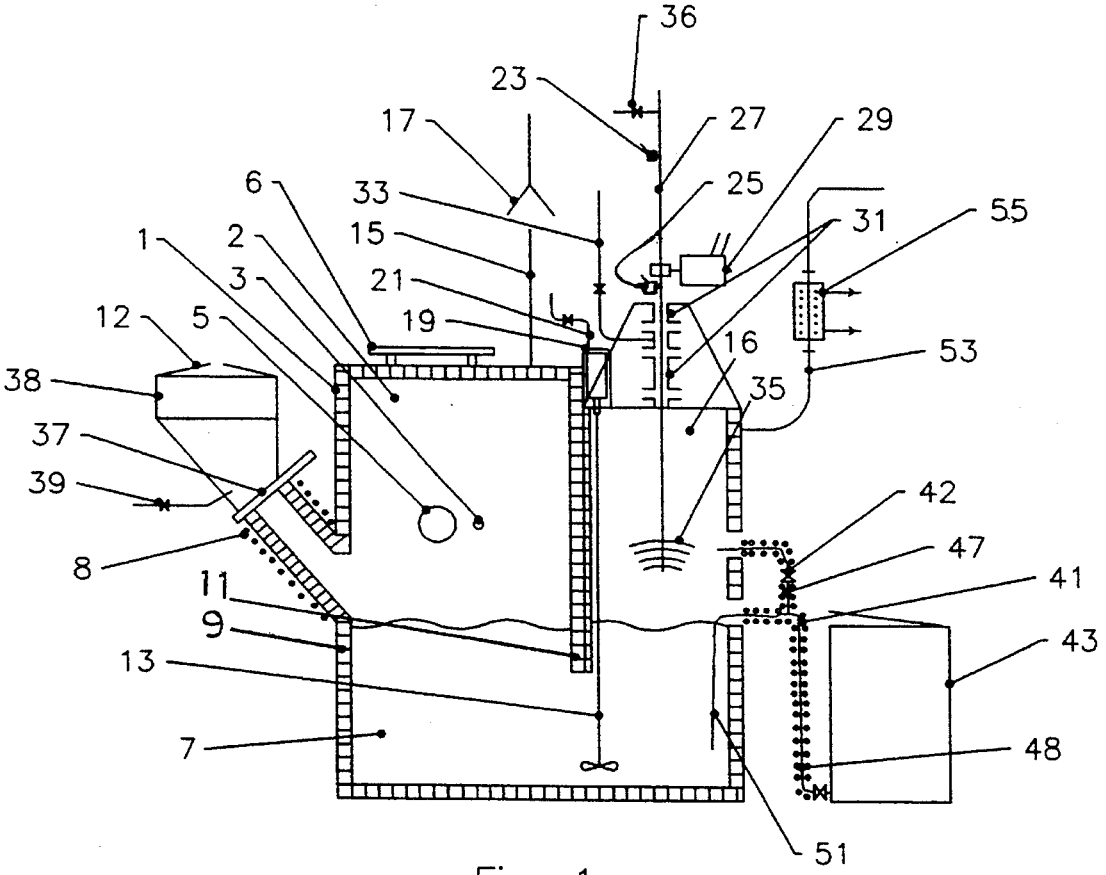
FIG. 1 shows a cross section of a front view of dual chamber treatment unit.

In FIG. 1 we've shown a sectional view of a dual chamber unit that is preferably made of a stainless steel such as 316 and ceramic lined. Ceramic lining 9 of a first or burner chamber 2 is necessary because burners 3, which may be one or more, heat metal 7, preferably magnesium from above the surface to a molten state with heat from the burners 3 and radiant heat from the ceramic lining 9. The air-fuel mixture to the burners 3 is automatically controlled to maintain a minimum of excess oxygen after combustion. Flue gas line 15 may discharge below a hooded cone shaped metal skirt 17 to aspirate air and cool the exit gas before entering the atmosphere. Waste heat could be utilized to form steam at or below this point by a properly designed exchanger or could be utilized directly for building heat by an air-gas exchanger.

Charging chute 38 may be hinged and sealed to allow easy addition of the magnesium. Viewing port 5 serves to allow visual checking of the burner adjustment and state of metal 7. A carbon layer may be used to float on molten magnesium to minimize magnesium oxide slag by reacting with excess oxygen. Molten metal draw off or overflow line 48 may be used to adjust level of metal 7 to be below feed chute 38 and above the end of baffle 11. This is necessary to seal gases in the first chamber 2 from gases in the melting and decomposition chamber 16. Flanged outlet 6 provides for cleaning and entry for repair of the lining.

Figure 3:
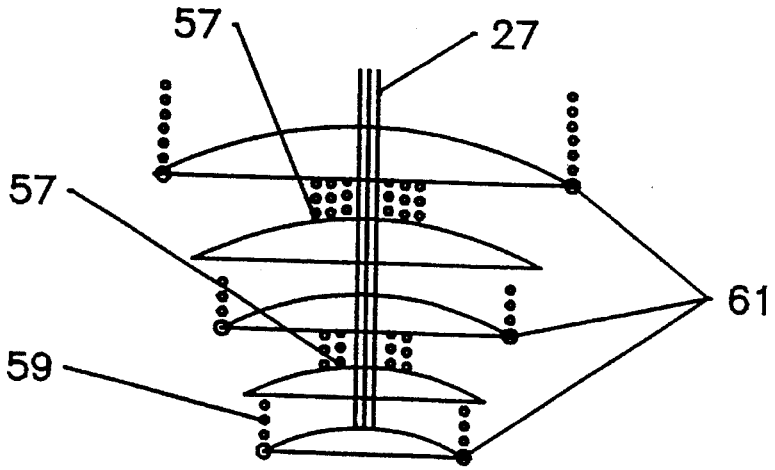
FIG. 3 shows an end view of the feed dispenser indicating gas path.

A pump type stirrer 13 may be installed vertically as shown or through the sidewall to mix the molten metal 7 to prevent excessive cooling below the melting and decomposition or 2nd chamber 16. The stirrer 13 must be below the greatest depth reached by feed disperser unit 35. Disperser 35 is shown in FIG. 3 and described in more detail later. Stirrer 13 is motor driven with covering 19 for motor drive and inert gas purge 21 controlled to prevent any outward seal leakage.

Shaft 27 for disperser 35 may be motor and gear driven 29 with limit switches 23 and 25 determining upper and lower limit of travel. Disperser 35 may be raised to be out of molten metal when not in use to prevent plugging. Inert gas purge 33 between shaft seals 31 prevents any outward leakage of gas from chamber 16. Inert gas purge 36 allows purging through hollow shaft 27 into disperser 35. This purge should be continous.

Figure 5:
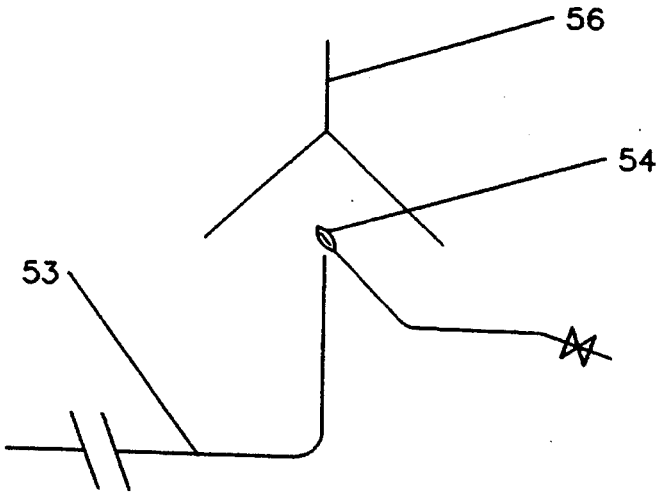
FIG. 5 shows one embodiment of an off-gas treatment unit.
Figure 6:
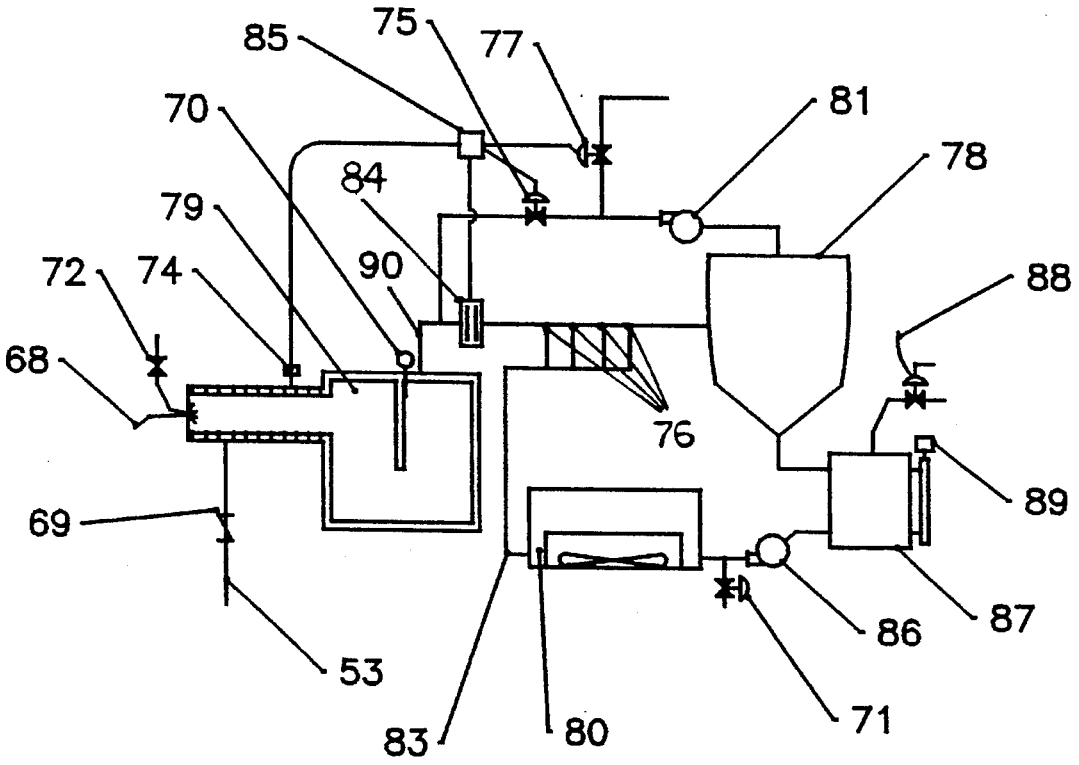
FIG. 6 shows an off-gas oxidative and scrubbing unit.

Feed chamber 38 may have dual doors 12 to open to admit magnesium into burner chamber 2. Magnesium feed may be manually controlled to maintain molten metal level. Slide gate 37 which may be gear driven is preferably interlocked to require dual hinged closure 12 to be closed before opening to dump magnesium into chamber 2. Incline of feed chute 38 is such that the metal will slide into chamber 2. Operation of slide gate 37 may also be manually controlled. In some installations molten metal may be fed continuously to chamber 2 from an external melting operation. Disperser 35 with feed outlet is controlled by limit switches 23 and 25 to submerse below the surface of molten metal 7. As gasses from decomposition escape they must bubble through a tortuous path in the molten metal 7 to escape through serrated edges of the disperser 35 and through off-gas line 53. Purge of inert gas through disperser 35 assures all gases formed will bubble through molten alloy 7. Experience has shown that the carbon formed will be almost totally carried out through off-gas line 53. In one preferred embodiment an induction heated ceramic section 55 may act as clean up by being heated to above 600°–800° C. for decomposition of hazardous molecules. In other embodiments further treatment is included as shown in FIGS. 5 and 6.

Magnesium chloride formed from the chlorine in the waste being pyrolyzed will remain molten but tend to sink toward the bottom of treatment chamber 16. Dip tube 51 will draw off from the bottom of chamber 16 to container 43 through electrically heated overflow line 48 and maintain the level of molten metal 7 about as shown. Unit line 47 acts to prevent siphoning. When necessary or desirable to empty the unit valve 42 may be closed to siphon most of the metal into container 43. Tracing with electric heater 41 is necessary to maintain metal and metal salt in a molten state.

Figure 2:
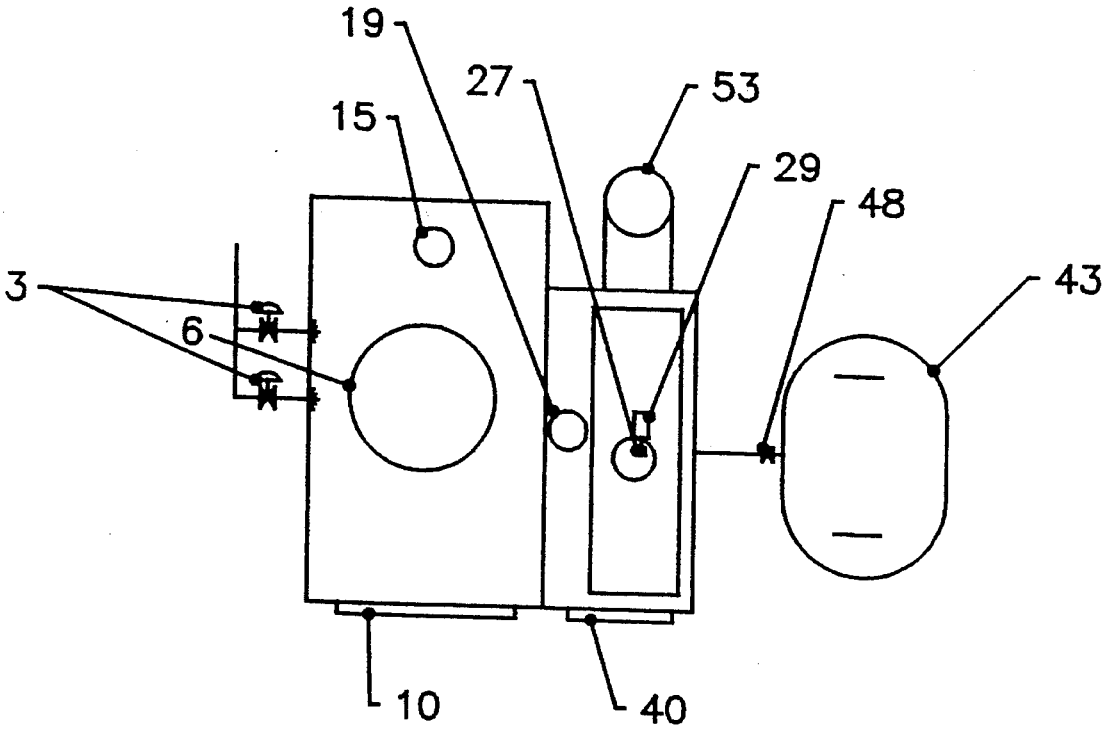
FIG. 2 shows a top view of the treatment unit.

FIG. 2 shows a top view of unit 1 indicating approximate shape for a unit that fits into a relatively narrow space. All the parts have been previously shown and explained except slag doors 10 in chamber 2 and slag door 40 in chamber 16. These doors should be well insulated and make an air tight closure. They may be opened to remove slag that may form on the surface of metal 7 although a bed of granular carbon on top of the molten metal should eliminate much of the slag.

In FIG. 3 we show an end view of a preferred embodiment for shape of disperser 35. This shape provides for an elongated path for products of decomposition to travel through and agitate the molten metal when the disperer 35 is at maximum depth. The unit consists of elongated dished baffles 61 with opening or holes 57 in alternate baffles and may be made of ½" thick stainless steel and ceramic coated. An external rib may be welded to the baffle and shaft 27 for added strength. Holes 57 in the baffles cause off-gas bubbles 59 to travel an elongated path for maximum metal contact to insure ample reaction time and sufficient metal contact.

Figure 4:
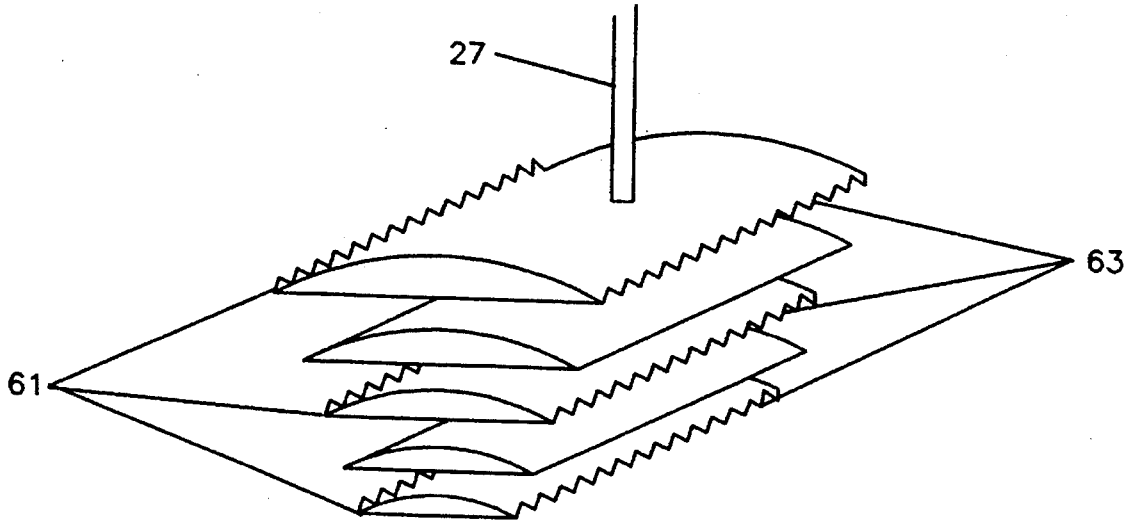
FIG. 4 shows a three dimensional view of the disperser unit.

In FIG. 4 we show a three dimensional view of disperser 35. Alternate baffles 61 have serrated edges 63 to cause gas from the decomposition to break into small bubbles to travel upward through molten metal 7.

In FIG. 5 we show one treatment for exit gas in line 53 from the heating and decomposition chamber 55. In this system the hot exit gas from chamber 55 leads to an open cone shaped chamber equipped with pilot burner 54 causing the hydrogen and carbon normally present in exit gas to be burned as the air mixture is thermally aspirated through vent line 56.

In FIG. 6, which is a preferred embodiment of an oxidative off-gas treatment system, the off-gas through line 53 goes through a check valve 69, with two check valves in series being preferred, to exit into a flame from burner 68. Before feeding a chlorinated waste into the decomposition unit, burner 68 is used to heat oxidation chamber 79 to above about 400° C. as indicated by temperature gauge 70. Controller 85 with blower 81 in operation may control recycle control valves 75 and vent valve 77 to maintain a slight negative pressure as indicated by gauge and sensor 74 in oxidation chamber 79. Exit gas comprising products of combustion of carbon, hydrogen and nay other combustible components exits oxidation chamber 79 through flow meter 84 and sprays from spray nozzles 76 to cyclone separator 78. Scrubbing liquid drains from cyclone separator 78 to hold up tank 87. Level controller 89 acts to add water to the system through drain 71. With pump 86 operating hot water is recycled through air cooler 80 to feed cool water through line 83 to spray nozzles 76. Pressure controller valve 77 allows venting of carbon dioxide and nitrogen to the atmosphere.

Figure 7:
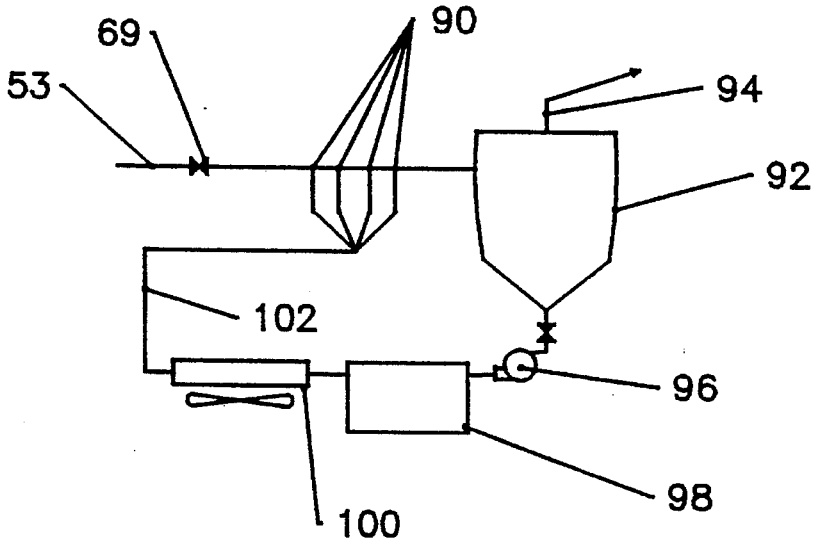
FIG. 7 shows an off-gas treatment system wherein moist carbon is removed from the off-gas by a scrubber unit.

In FIG. 7 we've shown a cyclone separator type scrubber 92 with vent line 94. Off-gas from line 53 flows through check valve 69 and is cooled by multiple spray nozzles 90 from an aqueous recycle stream in line 102. A carbon-water slurry falls to the bottom outlet of cyclone separator 92 to suction of sludge pump 96. Carbon is separated on a filter 98 which may be continuous discharge filter, or a filter providing for manual carbon discharge from removable filter canisters, with water going through air cooler or other type cooler 100 to recycle to spray nozzles 90.

What is claimed is:

1. Equipment and process for molecular decomposition of chlorinated compounds comprising:

a) a firebrick lined dual compartment unit;

b) a molten metal means in a first compartment of said dual compartment unit; said molten metal means reacting to hold chlorine from said chlorinated compounds in a molten stote in the form of a metal salt;

c) a heating means in a second compartment of said dual compartment unit to heat metal to form said molten metal means and to maintain said molten metal in a molten state;

d) a baffle means between said first compartment and said second compartment of said dual compartment unit to allow free flow of said molten metal means between said first compartment and said second compartment;

e) a purge means to purge oxygen from said second compartment above said molten metal means;

f) a feed means and a disperser means to feed said chlorinated compounds beneath a surface of said metal means in said second compartment and disperse decomposition products as they are formed;

g) an off-gas treatment means to remove carbon formed from decomposition of said chlorinated compounds before venting off-gas from said second compartment to the atmosphere.

2. A process and equipment as in claim 1 wherein said metal means is magnesium.

3. A process and equipment as in claim 1 wherein said metal means is zinc.

4. A process and equipment as in claim 1 wherein said metal means is calcium.

5. A process and equipment as in claim 1 wherein said metal means is a mixture of magnesium and zinc.

6. A process and equipment as in claim 1 wherein said metal means is a mixture of magnesium, zinc, and calcium.

7. A process as in claim 1 further comprising a chlorine detection means in said off-gas, interlocked to shut off feed of said chlorinated compounds when chlorine is detected.

8. A process and equipment as in claim 1 further comprising an automatic level control means to drain molten metal containing metal chloride from one of said compartments and a means to add said metal means to one of said chambers.

9. A process and equipment as in claim 1 wherein said means to scrub out carbon from decomposition of said chlorinated compounds is a cyclone separator and a continuous rotary filter with said carbon being drawn off from a bottom outlet from said cyclone separator and fed through said filter to separate said carbon as a damp solid from a filtrate that may be recycled through a cooler to said cyclone separator inlet.

10. Equipment and process as in claim 1 wherein said off-gas treating means is an oxidation unit.

11. Equipment and process as in claim 1 wherein said off-gas treating means is an oxidation unit followed by an aqueous scrubber.

12. Equipment and process as in claim 1 wherein said off-gas treating system comprises an aqueous scrubber and a filter to remove carbon in aqueous outlet from said scrubber.

13. Process and equipment as in claim 1 further comprising feeding solid carbon means to float on said molten metal means to reduce slag formation on a surface of said molten metal means.

* * * * *